US005146891A

United States Patent [19]

Nakazawa et al.

[11] Patent Number: 5,146,891

[45] Date of Patent: Sep. 15, 1992

[54] SYSTEM AND METHOD FOR CONTROLLING FUEL SUPPLY TO INTERNAL COMBUSTION ENGINE ACCORDING TO OPERATION OF AUTOMATIC TRANSMISION APPLICABLE TO AUTOMOTIVE VEHICLE

[75] Inventors: Shinsuke Nakazawa, Kanagawa; Yuji Kato, Tokyo; Tatsuo Wakahara, Kanagawa; Shigeki Shimanaka, Kanagawa; Hiroshi Asano, Kanagawa; Hiroshi Sasaki, Kanagawa; Hiroshi Yamaguchi, Kanagawa; Kazuhiro Ishigami, Kanagawa; Shinich Takenouchi, Kanagawa, all of Japan

[73] Assignee: Nissan Motor Company, Limited, Yokohama, Japan

[21] Appl. No.: 625,998

[22] Filed: Dec. 12, 1990

[30] Foreign Application Priority Data

Dec. 13, 1989 [JP] Japan ..... 1-321321
Dec. 18, 1989 [JP] Japan ..... 1-326072

[51] Int. Cl.[5] ..... F02D 41/12
[52] U.S. Cl. ..... 123/325; 123/493
[58] Field of Search ..... 123/325, 493

[56] References Cited

U.S. PATENT DOCUMENTS 4,221,191 9/1980 Asano et al. ..... 123/493 X
4,387,681 6/1983 Ikeura et al. ..... 123/325
4,508,088 4/1985 Hasegawa et al. ..... 123/493
4,694,796 9/1987 Mori ..... 123/493 X
4,790,275 12/1988 Iida ..... 123/493 X
4,841,447 6/1989 Hayashi et al. ..... 123/493 X

FOREIGN PATENT DOCUMENTS 62-159839 7/1987 Japan .

*Primary Examiner*—Tony M. Argenbright
*Attorney, Agent, or Firm*—Foley & Lardner

[57] ABSTRACT

A system and method for controlling an operation of an internal combustion engine of a vehicle having an automatic transmission in which at least one of predetermined fuel supply recovery engine revolution speed or predetermined fuel supply cut-off engine revolution speed is varied during the engine deceleration condition according to a state of operation of the automatic transmission. In the first preferred embodiment, a downshift operation of the automatic transmission is detected. In the second preferred embodiment, an overrun clutch solenoid is turned on (energized). In the latter case, both fuel supply recovery and fuel supply cut-off engine revolution speeds are set to higher values than those when the clutch solenoid is turned off (deenergized).

11 Claims, 7 Drawing Sheets

SYSTEM AND METHOD FOR CONTROLLING FUEL SUPPLY TO INTERNAL COMBUSTION ENGINE ACCORDING TO OPERATION OF AUTOMATIC TRANSMISION APPLICABLE TO AUTOMOTIVE VEHICLE

BACKGROUND OF THE INVENTION (1) Field of the invention

The present invention relates to a system and method for controlling fuel supply to an internal combustion engine according to a predetermined operation of an automatic transmission applicable to an automotive vehicle in which fuel supply cut-off during a predetermined engine deceleration is appropriately carried out.

(2) Background of the art

A Japanese Patent Application First Publication (Unexamined) Showa 62-87641 published on Apr. 22, 1987 and a U.S. Pat. No. 4,387,681 issued on June 14, 1983 exemplify previously proposed fuel supply controlling systems in which fuel supply is halted (hereinafter, referred to as fuel supply cut-off) is carried out when an engine revolutional speed exceeds a predetermined cut-off threshold during deceleration of the engine and the supply of fuel is resumed when the engine revolutional speed is reduced below a recovery speed value so that fuel consumption can be conserved.

In addition, a first control unit used for controlling an engine is installed independently of a second control unit used for controlling a shift range of an automatic transmission. Mutual communication is established between the first and second control units such that the first control unit controls the engine on the basis of an engine control request signal output from the second control unit.

In a previously proposed engine controlling system in which mutual communication between the control units is established, the second control unit temporarily produces an on, off, and on signal derived on the basis of a signal from an idling switch when the automatic transmission executes a shiftdown operation and the first control unit determines whether the fuel supply is to be cut off.

It is noted that when the engine revolutional speed is reduced, the fuel supply cut off is halted with a gear of the automatic transmission temporarily in a neutral position during the shift operation before the above-described operation (refer to FIG. 8). Therefore, in a case where the engine revolutional speed after the shift down operation does not exceed the fuel supply cut off revolutional speed due to a gear ratio, the fuel supply cut off cannot be executed.

If the fuel supply cut off is executed, the cut off may result in a variation of torque so that a shock (or jolt) will be generated.

Furthermore, Japanese Patent Application First Publication (unexamined) Showa 62-159839 published on July 15, 1987, exemplifies an automatic transmission in which a clutch (referred to as an overrun clutch) for controlling engine braking is installed to execute engine braking in accordance with a vehicle running condition in response to a signal derived from the second control unit. Such an overrun clutch as described above is controlled according to the energization and deenergization of an overrun clutch solenoid.

That is to say, when the overrun clutch solenoid is energized, the clutch is disengaged so as not to apply the engine braking force to the vehicle and when the overrun clutch solenoid is deenergized, the clutch is engaged so as to apply the engine braking force.

However, the following problem arises: when the overrun clutch is disengaged, the engine revolutional speed is quickly reduced due to the non-application of engine braking. If the fuel supply is recovered, the engine revolutional speed often drops to a speed below a normal idling speed. Consequently, engine stalling occurs.

On the other hand, if the fuel recovery speed is increased, the fuel recovery timing becomes earlier than expected so that the fuel consumption cannot be conserved.

SUMMARY OF THE INVENTION

It is therefore an object of the present invention to provide a system and method for controlling fuel supply to an internal combustion engine applicable to a vehicle having an automatic transmission which achieves an appropriate saving of fuel supply with no occurrence of engine stalling although engine revolutional speed is reduced.

The above-described object can be achieved by providing a system for controlling an operation of an internal combustion engine of a vehicle having an automatic transmission, comprising: a) first means for detecting a dynamic operating characteristic of the engine; b) second means for detecting whether a first factor inherent to a characteristic of the automatic transmission which influences fuel consumption of the engine occurs; c) third means for detecting whether an idle switch associated with the engine has been turned on; and d) fourth means for varying and setting a second factor inherent to the dynamic operating characteristic of the engine for determining a fuel consumption of the engine with respect to the dynamic operating characteristic of the engine according to a state of the first factor when the first means detects that the idle switch has been turned on.

The above-described object can also be achieved by providing a system for controlling an operation of an internal combustion engine of a vehicle having an automatic transmission, comprising: a) first means for detecting an engine revolutional speed; b) second means for detecting whether the engine falls in a predetermined deceleration condition; c) third means for detecting whether a downshift operation of a gear position of the automatic transmission occurs; d) fourth means for detecting whether a clutch used for controlling an engine brake is engaged; and e) fifth means for varying and setting at least one of predetermined engine revolutional speeds at which a fuel supply recovery is executed during the predetermined engine deceleration when at least one of the downshift operation or the clutch is engaged so that a region of the engine revolutional speed in which the fuel supply cut-off is executed is widened.

The above-described object can also be achieved by providing a method for controlling an operation of an internal combustion engine of a vehicle having an automatic transmission, comprising: a) detecting a dynamic operating characteristic of the engine; b) detecting whether a first factor inherent to a characteristic of the automatic transmission which influences on a fuel consumption of the engine occurs; c) detecting whether an idle switch associated with said engine has been turned on; d) varying and setting a second factor inherent to the dynamic operating characteristic of the engine for determining a fuel consumption of the engine with respect to the dynamic operating characteristic of the engine according to a state of the first factor when it is detected in step c) that the idle switch has been turned on.

DETAILED DESCRIPTION OF THE PREFERRED EMBODIMENT

Reference will hereinafter be made to the drawings in order to facilitate a better understanding of the present invention.

Figure 1:
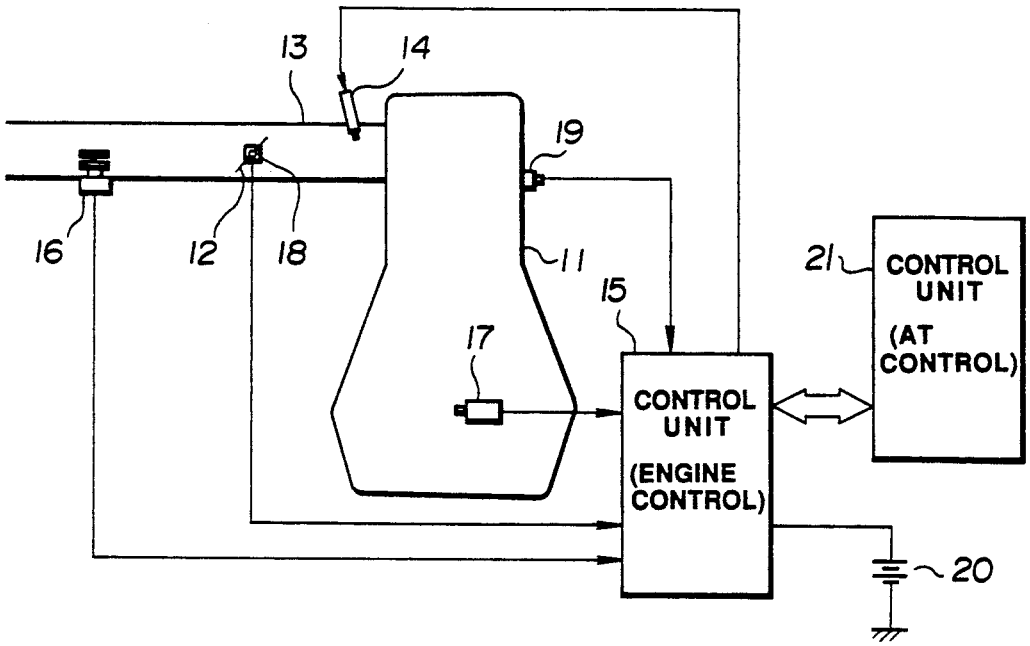
FIG. 1 is a schematic circuit block diagram of a system for controlling a fuel supply to an internal combustion engine applied to a vehicular engine and automatic transmission according to the present invention.

FIG. 1 shows a first preferred embodiment of a system for controlling an engine fuel supply which is applied to an internal combustion engine of a vehicle having an automatic transmission.

A first control unit 15 used for controlling an engine is installed with an engine of the vehicle independently of a second control unit 21 used for controlling the automatic transmission. Both first and second control units 15 and 21 are mutually communicated. The first control unit 15 controls the engine on the basis of an engine control request signal derived from the second control unit 21.

Engine body 11 is provided with a throttle valve 12 which is actuated in accordance with an accelerator pedal. An engine intake air is sucked from an air cleaner via the throttle valve 12 and via an intake manifold 13.

A branch portion of the intake manifold 13 is provided with a fuel injection valve 14 (injector) for each an engine cylinder. The fuel injector 14 is an electromagnetic type fuel injection valve which opens when its solenoid portion is energized and which closes when the power supply to its solenoid portion is halted. When the solenoid of the fuel injector 14 is energized and opens in response to a pulse signal derived from the first control unit 15, the fuel supplied from a fuel pump (not shown) is pressurized and the fuel whose pressure is adjusted to a predetermined pressure by means of a fuel pressure regulator is injected through the fuel injector into the engine body 11.

Figure 2:
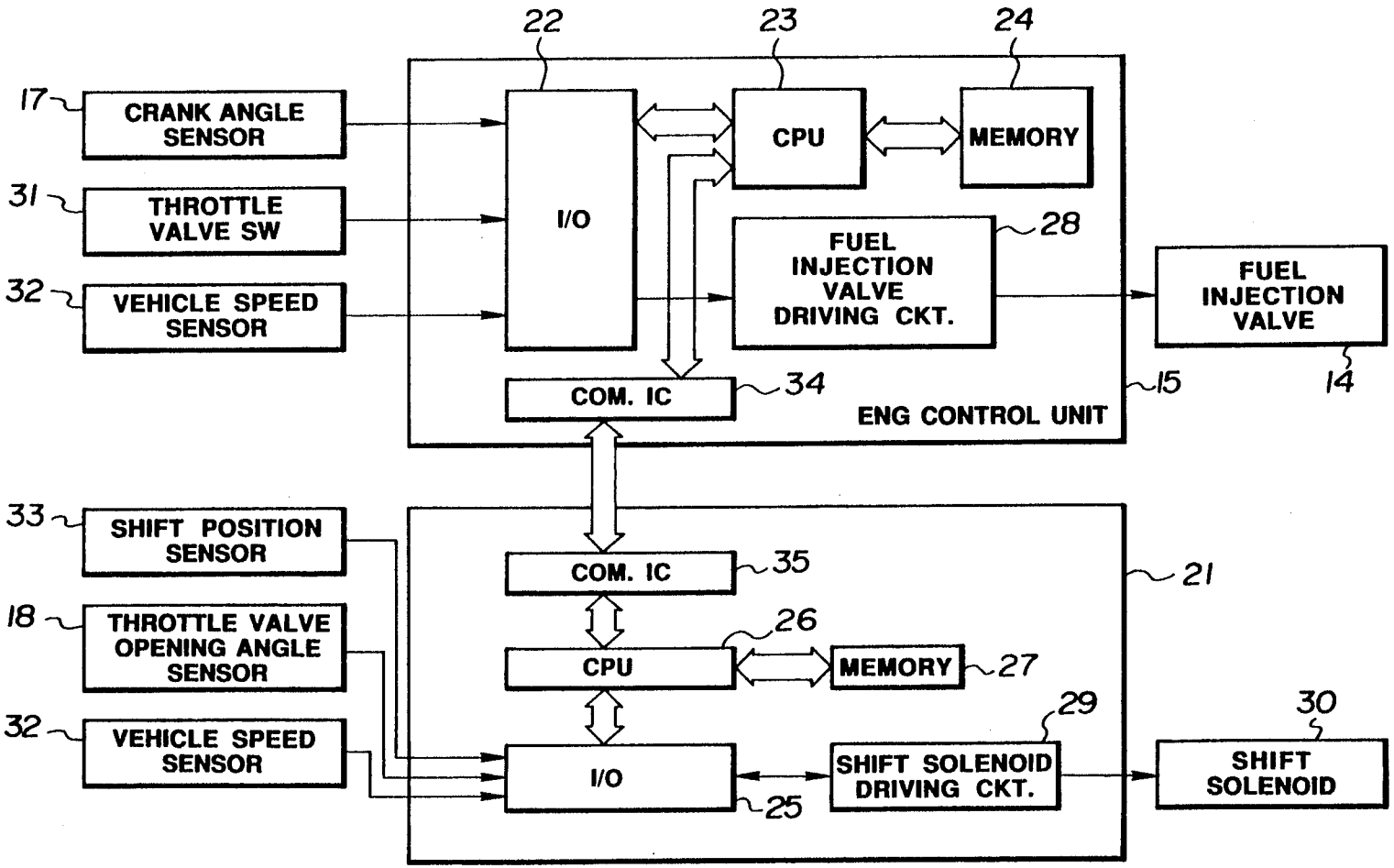
FIG. 2 is a schematic circuit block diagram of a first control unit used for controlling the engine and a second control unit used for controlling an automatic transmission as shown in FIG. 1 in a first preferred embodiment.

As shown in FIG. 2, engine control unit 15 for controlling the engine receives an output signal from various types of sensors and processes arithmetic operations using an incorporated I/O 22, CPU 23, and memory 24 to define a fuel injection quantity (fuel injection time) Ti and fuel injection timing (fuel injection system) and outputs a fuel injection pulse signal to the fuel injector 14 via a driving circuit 28.

Various types of sensors include an air flow meter 16 as an intake air quantity sensor located upstream of the throttle valve 12 which outputs a signal according to an intake air quantity Q. A crank angle sensor 17 is installed in an ignition pulse distributor (not shown). In the case of a six cylinder engine, the crank angle sensor 17 produces a reference signal for each rotation of 120°. The reference signal is used for measuring an engine revolutional speed N.

A throttle valve switch 31 is installed on the throttle valve 12 for producing a throttle signal when the throttle valve is fully closed and fully open. A coolant temperature sensor 19 is installed for detecting a coolant temperature of the engine Tw. In addition, a vehicle speed sensor 22 produces a pulse in proportion to the vehicle speed. A voltage VB of a vehicular battery 20 is applied to the control unit 15 for detecting the battery voltage VB.

On the other hand, the second control unit 21 receives output signals from various types of sensors as shown in FIG. 2, and processes these arithmetically using the incorporated I/O 25, CPU 26, memory 27 and so on, to control a shift solenoid 30 via a shift solenoid driving circuit 29 to execute a shift control operation.

The sensors connected to the second control unit 21 include a shift position switch 33, throttle valve opening angle sensor 18, and vehicle speed sensor 32.

It is noted that each communication IC (integrated Circuit) 34 and 35 is incorporated into the corresponding control unit 15, 21 to enable the first control unit 15 to perform engine control operations on the basis of the engine control request signals derived from the second control unit 21.

Figure 3:
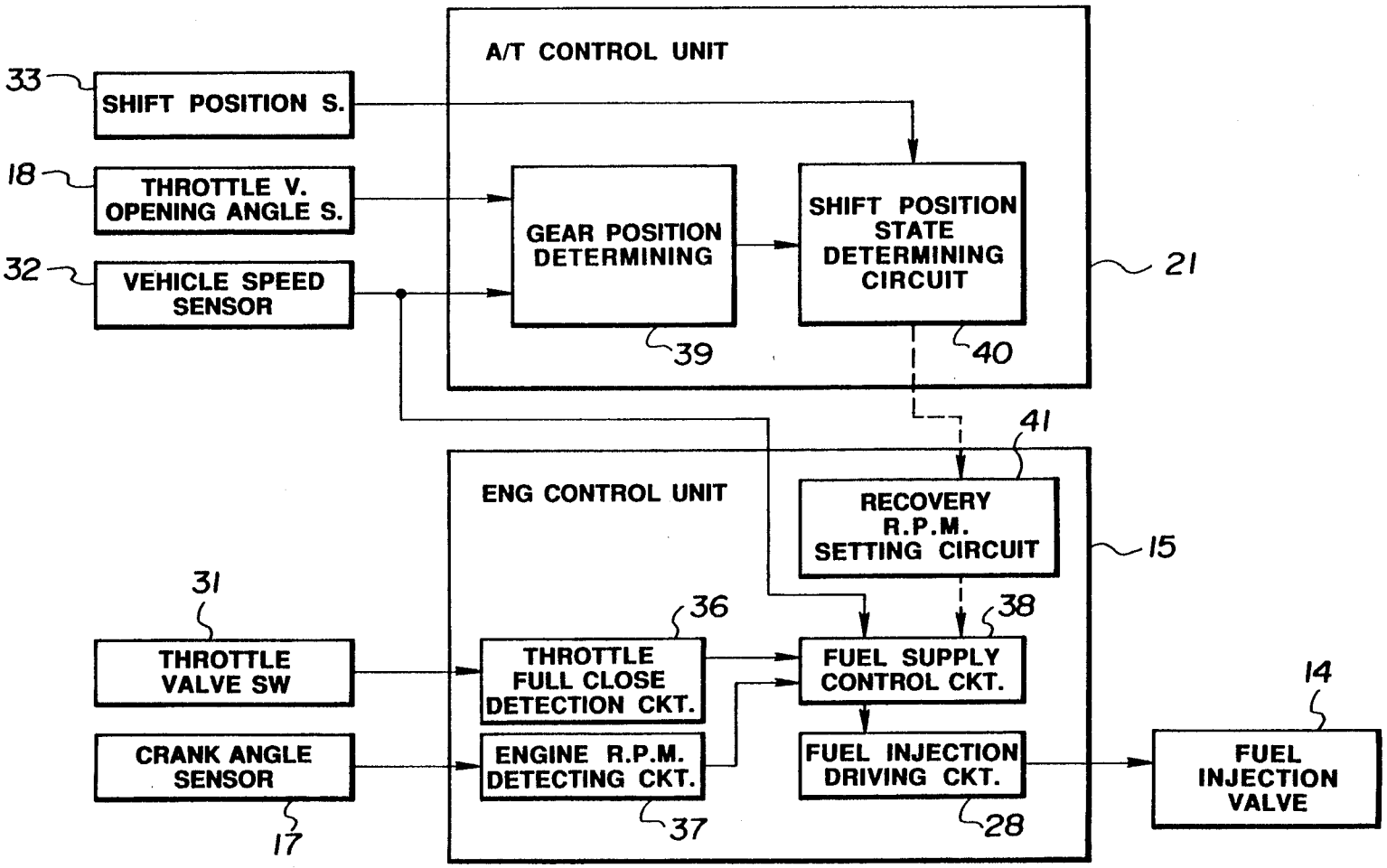
FIG. 3 is a circuit block diagram of the first and second control units shown in FIG. 2.

As shown in FIG. 3, the first control unit 15 functionally includes a throttle valve fully closed state detecting circuit 36 for detecting a fully closed state of the throttle valve 12 on the basis of the output signal from the throttle valve switch 31, an engine revolutional speed detecting circuit 37 for detecting the engine revolutional speed N on the basis of the reference signal of the crank angle sensor 17, and fuel supply control block 38 in which on the basis of output signals from the detection circuits 36, 37 and vehicle speed sensor 32, during an engine deceleration, a fuel supply cut off is started when the engine revolutional speed is above a predetermined cut off revolutional speed and a fuel supply resumption is carried out when the engine revolutional speed is below a predetermined recovery engine revolutional speed.

The second control unit 21 functionally includes a gear position determining circuit 39 operated on the basis of output signals from the throttle opening angle sensor 18 and vehicle speed sensor 32 and shift state determining block for determining a shift operation state on the basis of the output signal of the shift position switch 33 and gear position determining circuit 39.

In addition, the first control unit 15 includes a recovery revolutional speed setting block 41 for reducing the fuel recovery revolutional speed during the end of the shift operation when the downshift range is detected. The fuel supply controlling block 38 outputs the signal to the driving circuit 28 of the fuel injector 14.

Figure 4:
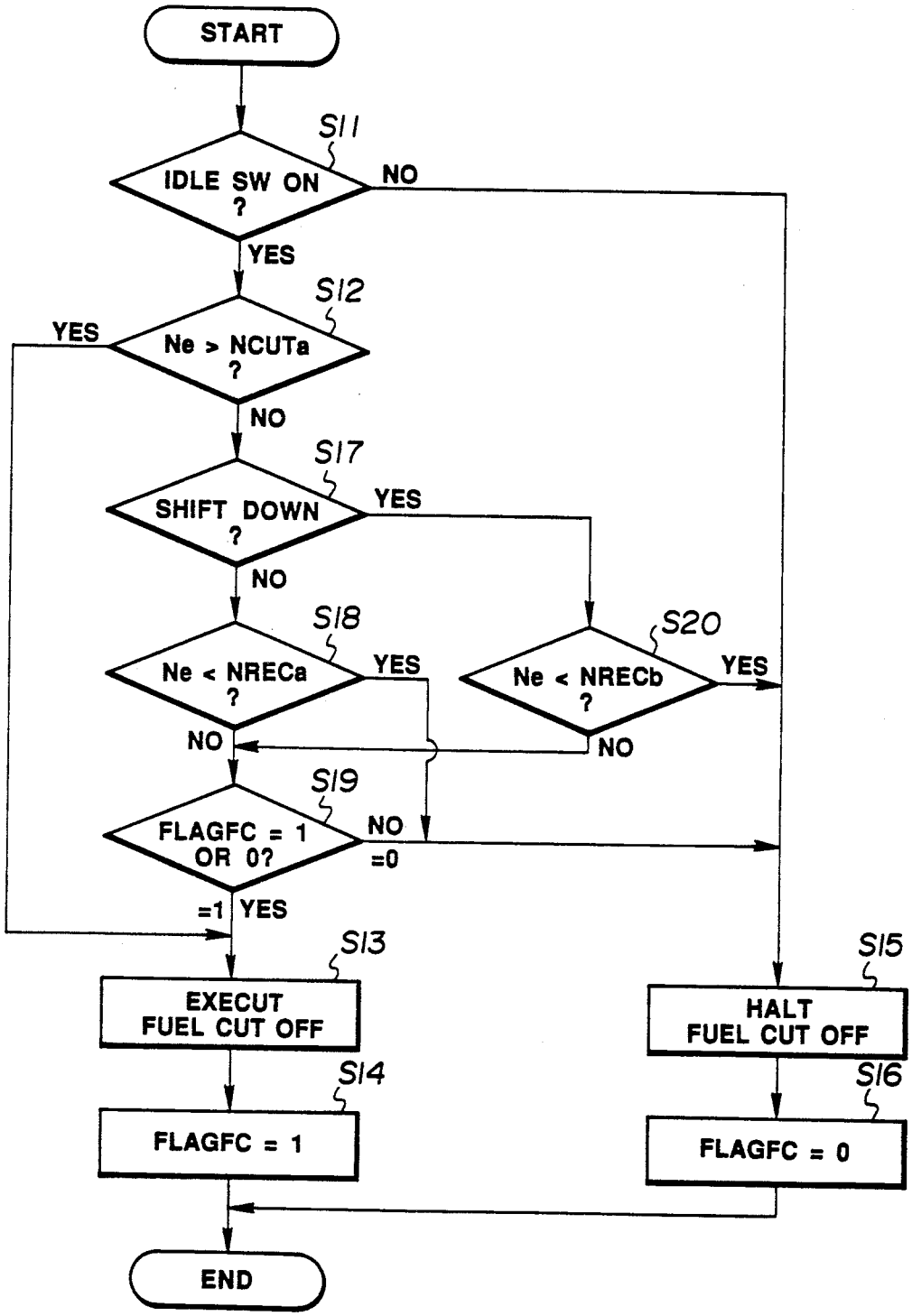
FIG. 4 is an operational flowchart indicating an operation of the first control unit.

An operation of the above-described fuel supply controlling system of the preferred embodiment will be described with reference to FIG. 4.

Figure 5:
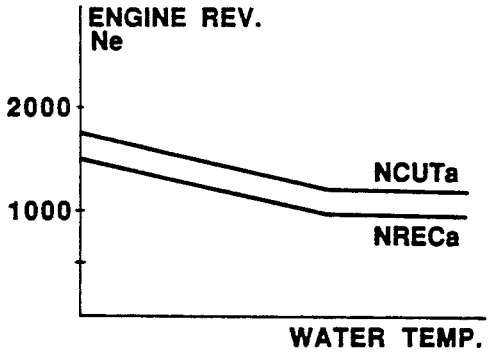
FIGS. 5 and 6 are characteristic graphs of engine revolutional speed with respect to a coolant temperature of the engine shown in FIG. 1.

In step S11, the first control unit 15 determines whether the throttle valve switch 31 has been turned on. If the throttle valve switch 31 is turned on, the routine goes to a step S12 in which the first control unit 31 compares the engine revolutional speed Ne with a predetermined engine revolutional speed which is referred to as a fuel supply cut off revolutional speed NCUTa (refer to FIG. 5). If Ne>NCUTa, the routine goes to a step S13 in which the fuel supply is cut off and goes to a step S14 in which a flag (FLAGFC=1) is set to 1. On the other hand, if the idle (throttle valve) switch is turned off in a step S11, the routine goes to a step S15 in which the fuel supply cut-off is halted and then goes to a step S16 in which the flag is set to 0 (FLAGFC=0).

In the step S12, if Ne≦NCUTa, the routine goes to a step S17 in which the first control unit 15 transmits a request signal to the second control unit 21 to determine whether a downshift change condition occurs. If not in the downshift condition, the routine goes to a step S18 in which the engine revolutional speed Ne is compared with a fuel recovery revolutional speed NRECa (see to FIG. 5). If Ne<NRECa, the routine goes to a step S15 in which the fuel supply cut-off is halted. If Ne≧NRECa in the step S15, the routine goes to a step S19 in which the first control unit 15 determines whether the flag FLAGFC is set to 1 or 0. If the flag FLAGFC is 1, the routine goes to a step S13 in which the fuel supply cut-off is continued. If FLAGFC is 0, the routine goes to the step S15 in which the fuel supply cut-off halt is continued.

Figure 6:
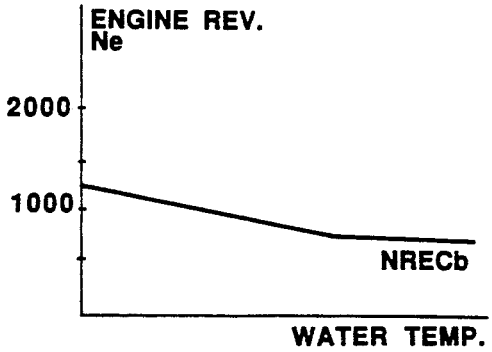

On the other hand, if the determination in step S17 indicates the downshift condition, the routine goes to a step S20 in which the engine revolutional speed Ne is compared with a second recovery engine revolutional speed NRECb (see to FIG. 6) which is set lower than the fuel recovery revolutional speed NRECa. If Ne<NRECb, the routine goes to a step S15 in which the fuel supply cut-off is halted. If Ne≧NRECb, the routine goes to a step S19.

As described hereinabove, when the automatic transmission is shifted down, the throttle valve switch 31 temporarily outputs an on-off-on signal. In a case where the fuel supply cut-off is again determined, the fuel recovery revolutional speed is set lower than the fuel recovery revolutional speed set during the normal control operation. Therefore, the fuel recovery can be prevented due to the reduction of the engine revolutional speed at the time of a shift (down) operation.

Figure 7:
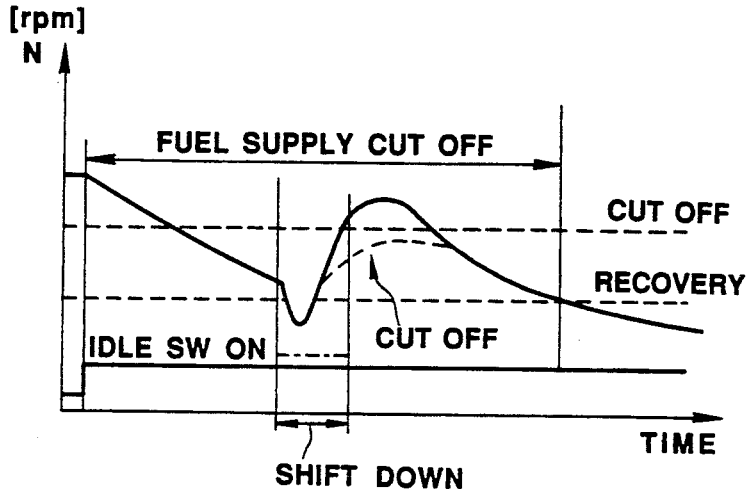
FIGS. 7 and 8 are characteristic graphs of engine revolutional speed change with respect to time when a downshift operation of the automatic transmission occurs.
Figure 8:
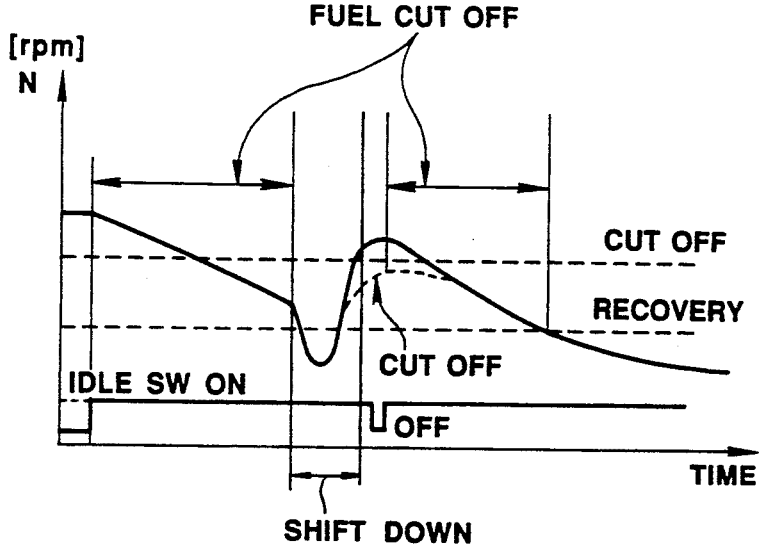

In addition, since no torque variation occurs due to the fuel recovery and cut, the occurrence of shock can be prevented (see to FIG. 7).

Figure 9:
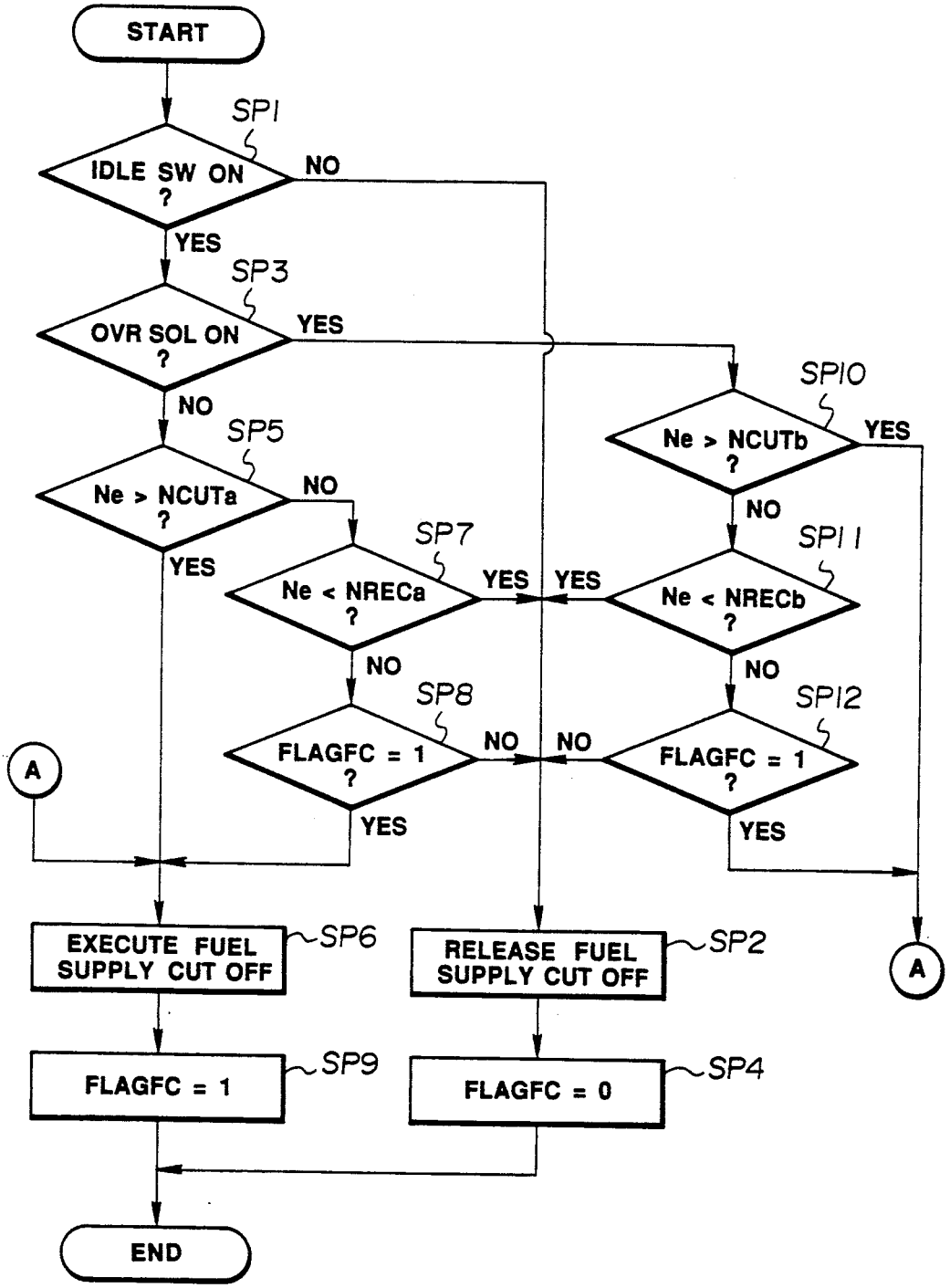
FIG. 9 is an operational flowchart of an operation of the engine controlling system in a second preferred embodiment according to the present invention.

FIG. 9 shows an operational flowchart of a system for controlling the fuel supply to the internal combustion engine in a second preferred embodiment according to the present invention.

It is noted that the structure of the second preferred embodiment is substantially the same as in the first preferred embodiment.

The second control unit 21 is provided with a gear position determining circuit 39 which determines which gear position of the automatic transmission is placed on the basis of the output signal from the throttle valve opening angle sensor 18 and vehicle speed sensor 32 and a solenoid control means 40 which executes an on-off control for a solenoid of an overrun clutch (OVR-C) 41 (a clutch installed for engine brake control of the engine brake clutch).

In addition, the first control unit 15 functionally includes fuel cut-off recovery revolutional speed setting means 42 for setting both the fuel supply cut-off revolutional speed and fuel supply recovery revolutional speed higher when the solenoid is turned on (clutch disengagement, engine braking does not occur) on the basis of the output signal derived from the solenoid control means 40 and for setting both of them lower than the cut-off revolutional speed and recovery revolutional speed when the solenoid is turned off.

Furthermore, the output signal from the fuel supply controlling means 38 is input to the drive circuit 28 of the fuel injection valve 14.

Next, the operational flowchart of FIG. 9 will be described below.

In a step SP1, the first control unit 15 determines whether the throttle valve switch 31 (idle switch) is in the off state. If the idle switch is not turned on, the routine goes to a step SP2. If turned on, the routine goes to a step SP3.

In the step SP2, the fuel cut-off is released. In a step SP4, the flag is set to 0 (FLAGFC=0).

Figure 10:
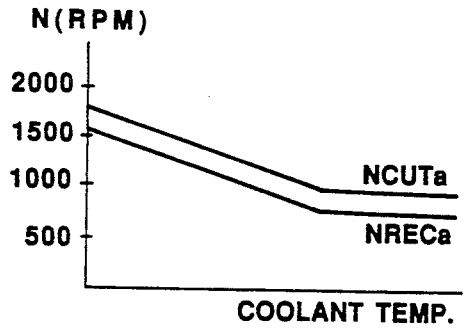
FIGS. 10 and 11 are characteristic graphs of engine revolutional speed with respect to the coolant temperature.

In the step SP3, the first control unit 15 transmits the request signal to the second control unit 21 to determine whether the control solenoid for the overrun clutch 41 is turned on. If the solenoid is turned off, i.e., the clutch 41 is engaged and engine braking is applied, the routine goes to the step S5 in which the first control unit 15 compares the engine revolutional speed Ne with the high set fuel cut-off revolutional speed NCUTa (refer to FIG. 10). If Ne>NCUTa, the routine goes to the step SP2 in which the fuel supply cut-off is released. If Ne<NRECa, the routine goes to a step SP8 in which the control unit 15 determines whether the flag is set to 1 or 0.

Figure 11:
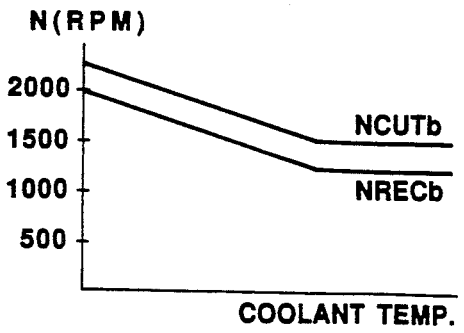

In the step SP7, the first control unit 15 compares the engine revolutional speed Ne with the lower set fuel recovery revolutional speed NRECa (refer to FIG. 11). If Ne≧NRECa, the routine goes to the step S8 in which the first control unit 15 determines whether the flag indicates 1 or 0. If the flag indicates 0, the routine goes to the step SP2. If the flag indicates 1, the routine goes to the step SP6 in which the fuel supply cut-off is executed. In the step SP9, the flag is set to 1 (FLAGFC=1).

In the step SP3, the first control unit 15 determines whether the solenoid of the overrun clutch 41 is turned on (energized), i.e., when the clutch 41 is disengaged and the engine braking is not applied, the routine goes to a step S10 in which the engine revolutional speed Ne is compared with the high set fuel cut-off revolutional speed NCUTb (refer to FIG. 11). If Ne<NRECb, the routine goes to the step SP12 in which the first control unit 16 determines whether the flag is turned to 1 or 0. If the flag indicates 0, the routine goes to the step SP2. If the flag is set to 1, the routine goes to the step SP5.

Figure 12:
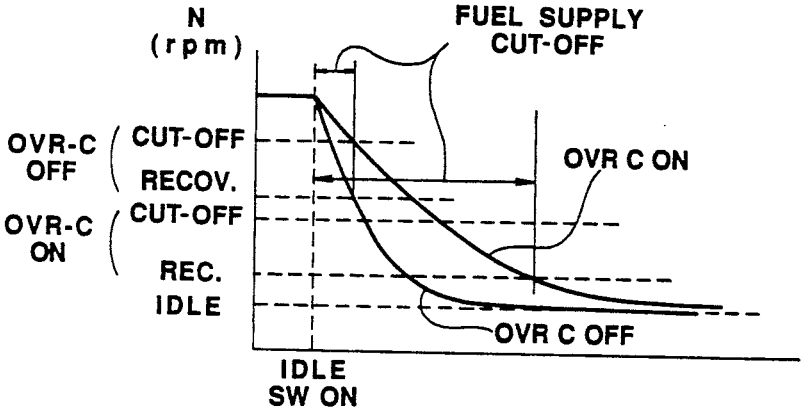
FIGS. 12 and 13 are characteristic graphs of engine revolutional speed with respect to time when an overrun clutch is turned on and off, respectively.
Figure 13:
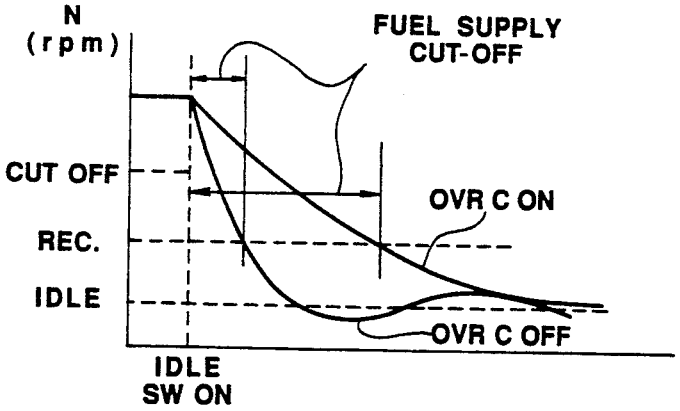

As described above, in the second preferred embodiment, when the control solenoid of the overrun clutch 41 is turned on, in other words, when the clutch 41 is disengaged and engine braking is applied, both fuel cut-off revolutional speed and fuel recovery revolutional speed are set lower (see FIG. 12).

When the overrun clutch 41 is engaged, both the fuel supply cut-off and recovery are carried out on the basis of the lower set fuel cut-off revolutional speed and fuel recovery revolutional speed. Therefore, the fuel supply is not quickly recovered but fuel consumption can be conserved.

Although, in the second preferred embodiment, the fuel cut-off and recovery timing are controlled by switching the fuel cut-off and recovery revolutional speeds, a delay time to initiate the fuel supply cut-off may be changed to control the fuel supply cut-off and recovery timing.

For example, when the engine braking is not applied with the overrun clutch 41 disengaged, the delay time to start the fuel supply cut-off is shortened and fuel consumption is improved. When the overrun clutch 41 is engaged with the engine braking applied, the delay time to start the fuel cut-off is elongated and the fuel supply cut-off is inhibited.

As described hereinabove, since, in the first preferred embodiment, when the downshift operation of the automatic transmission is detected, the fuel recovery engine revolutional speed is temporarily lowered to prevent fuel recovery from occurring due to the reduction of the engine revolutional speed during the downshift operation, the fuel supply cut-off region can be extended and the torque variation of the engine due to fuel recovery and fuel supply cut-off can be prevented. Thus, the shock to the vehicle body can be prevented.

When, in the second preferred embodiment, the engagement of the engine brake controlling clutch is detected, the timings of both fuel cut off and fuel recovery can be delayed. In addition, when the disengagement of the clutch is detected, the timing of both the fuel supply cut-off and fuel recovery can be quickened. Therefore engine stalling cannot occur, and fuel consumption can be conserved.

It will fully be appreciated by those skilled in the art that the foregoing description has been made in terms of the preferred embodiments and various changes and modifications may be made without departing from the scope and spirit of the present invention which is to be defined by the appended claims.

What is claimed is:

1. A system for controlling an operation of an internal combustion engine of a vehicle having an automatic transmission, comprising:

a) first means for detecting a dynamic operating characteristic of the engine;

b) second means for detecting whether a first factor inherent to a characteristic of the automatic transmission which influences fuel consumption of the engine occurs, said second means including a first sensor for detecting whether an overrun clutch installed in the automatic transmission and used for controlling engine braking is turned on;

c) third means for detecting whether an idle switch associated with the engine has been turned on; and d) fourth means for varying and setting a second factor inherent to the dynamic operating characteristic of the engine for determining a fuel consumption of the engine with respect to the dynamic operating characteristic of the engine according to a state of the first factor when the first means detects that the idle switch has been turned on, said fourth means varying and setting at least one of a fuel supply recovery engine revolutional speed at which the fuel supply cut-off is released and a fuel supply cut-off engine revolutional speed at which the fuel supply cut-off is executed to higher values when an overrun clutch solenoid is turned off, and setting both the fuel recovery and the fuel supply cut-off engine revolutional speeds to lower values when the overrun clutch solenoid is turned on.

2. A system as set forth in claim 1, wherein the second means includes fifth means for detecting whether a downshift operation of gear position occurs in the automatic transmission and wherein the fourth means varies and sets a fuel recovery engine revolutional speed at which a supply of fuel to the engine is resumed when the fourth means detects that the downshift operation of the automatic transmission occurs, the fuel recovery engine revolutional speed being set to a value lower than a normal fuel supply recovery engine revolutional speed at this time, when no downshift operation occurs, so that a region of a fuel supply cut-off with respect to the engine revolutional speed is widened.

3. A system as set forth in claim 1, wherein the second means includes fifth means for detecting whether an overrun clutch solenoid installed in the automatic transmission and used for controlling engine braking is turned on and wherein the fourth means varies and sets both timings of a fuel supply recovery engine revolutional speed at which the fuel supply cut-off is released and a fuel supply cut-off engine revolutional speed at which the fuel supply cut-off is executed earlier when the overrun clutch solenoid is turned off and both timings of the fuel supply recovery and fuel supply cut-off engine revolutional speeds are executed later when the overrun clutch solenoid is turned on.

4. A system for controlling an operation of an internal combustion engine of a vehicle having an automatic transmission, comprising:

a) first means for detecting a dynamic operating characteristic of the engine;

b) second means for detecting whether a first factor inherent to a characteristic of the automatic transmission which influences fuel consumption of the engine occurs;

c) third means for detecting whether an idle switch associated with the engine has been turned on;

d) fourth means for varying and setting a second factor inherent to the dynamic operating characteristic of the engine for determining a fuel consumption of the engine with respect to the dynamic operating characteristic of the engine according to a state of the first factor when the first means detects that the idle switch has been turned on and;

wherein the second means includes fifth means for detecting whether a downshift operation of a gear position occurs in the automatic transmission and wherein the fourth means varies and sets a fuel recovery engine revolutional speed at which a supply of fuel to the engine is resumed when the fourth means detects that the downshift operation of the automatic transmission occurs, the fuel recovery engine revolutional speed being set to a value lower than a normal fuel supply recovery engine revolutional speed when no downshift operation occurs, so that a region of a fuel supply cut-off with respect to the engine revolutional speed is widened.

5. A system as set forth in claim 4, wherein the first means includes sixth means for detecting an engine revolutional speed and seventh means for detecting an engine coolant temperature, the fuel supply recovery engine revolutional speed being varied and set according to the engine coolant temperature.

6. A system for controlling an operation of an internal combustion engine of a vehicle having an automatic transmission, comprising:

a) first means for detecting a dynamic operating characteristic of the engine;

b) second means for detecting whether a first factor inherent to a characteristic of the automatic transmission which influences fuel consumption of the engine occurs;

c) third means for detecting whether an idle switch associated with the engine has been turned on;

d) fourth means for varying and setting a second factor inherent to the dynamic operating characteristic of the engine for determining a fuel consumption of the engine with respect to the dynamic operating characteristic of the engine according to a state of the first factor when the first means detects that the idle switch has been turned on and;

wherein the second means includes fifth means for detecting whether an overrun clutch solenoid installed in the automatic transmission and used for controlling engine braking is turned on and wherein the fourth means varies and sets both timings of a fuel supply recovery engine revolutional speed at which the fuel supply cut-off is released and a fuel supply cut-off engine revolutional speed at which the fuel supply cut-off is executed earlier when the overrun clutch solenoid is turned off and both timings of the fuel supply recovery and fuel supply cut-off engine revolutional speeds are executed later when the overrun clutch solenoid is turned on.

7. A system for controlling an operation of an internal combustion engine of a vehicle having an automatic transmission, comprising:

a) first means for detecting an engine revolutional speed;

b) second means for detecting whether the engine falls in a predetermined deceleration condition;

c) third means downshift operation of a gear position of the automatic transmission occurs;

d) fourth means for detecting whether a clutch used for controlling an engine brake is engaged; and e) fifth means for varying and setting at least one of predetermined engine revolutional speeds at which a fuel supply recovery is executed during the predetermined engine deceleration when at least one of said downshift operation and clutch is engaged so that a region of the engine revolutional speed in which the fuel supply cut-off is executed is widened.

8. A system as set forth in claim 7, wherein when the third means detects that the downshift operation occurs, the fifth means varies and sets the fuel recovery engine revolutional speed to a lower value than that when no downshift operation occurs.

9. A system as set forth in claim 7, wherein when the fourth means detects that the clutch is engaged, the fifth means varies and sets both fuel recovery engine revolutional speed and fuel supply cut-off engine revolutional speed to lower values than those when the clutch is disengaged.

10. A system as set forth in claim 7, wherein when the fourth means detects that the clutch is disengaged, the fifth means varies and sets both fuel supply recovery and fuel supply cut-off engine revolutional speeds to higher values than those set when the clutch is engaged.

11. A method for controlling an operation of an internal combustion engine of a vehicle having an automatic transmission, comprising:

a) detecting a dynamic operating characteristic of the engine;

b) detecting whether a first factor inherent to a characteristic of the automatic transmission which influences fuel consumption of the engine occurs, said detection including detecting whether an overrun clutch installed in the automatic transmission and used for controlling engine braking is turned on;

c) detecting whether an idle switch associated with said engine has been turned on; and d) varying and setting a second factor inherent to the dynamic operating characteristic of the engine for determining a fuel consumption of the engine with respect to the dynamic operating characteristic of the engine according to a state of the first factor when it is detected in the step c) that the idle switch has been turned on; varying and setting at least one of a fuel supply recovery engine revolutional speed at which the fuel supply cut-off is released and a fuel supply cut-off engine revolutional speed at which the fuel supply cut-off is executed to higher values when the overrun clutch is turned off and setting both the fuel recovery and the fuel supply cut-off engine revolutional speeds to lower values when the overrun clutch solenoid is turned on.

* * * * *